US006986793B2

(12) United States Patent
Stoyanov et al.

(10) Patent No.: US 6,986,793 B2
(45) Date of Patent: Jan. 17, 2006

(54) METHOD FOR MAKING BLEACHED CROSSLINKED CELLULOSIC FIBERS WITH HIGH COLOR AND BRIGHTNESS

(75) Inventors: Angel Stoyanov, Seattle, WA (US); Shahrokh A. Naieni, Seattle, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/815,145

(22) Filed: Mar. 31, 2004

(65) Prior Publication Data

US 2005/0223501 A1 Oct. 13, 2005

(51) Int. Cl.
*D06M 11/00* (2006.01)

(52) U.S. Cl. ..... 8/116.1; 162/9; 162/157.6

(58) Field of Classification Search ..... 8/115.15, 8/116.1; 162/157.6, 9
See application file for complete search history.

(56) References Cited

U.S. PATENT DOCUMENTS

| | | | | |
|---|---|---|---|---|
| 5,562,740 | A | 10/1996 | Cook et al. | |
| 5,609,727 | A * | 3/1997 | Hansen et al. | 162/184 |
| 5,779,857 | A | 7/1998 | Norlander | |
| 5,873,979 | A * | 2/1999 | Naieni | 162/157.6 |
| 6,176,973 | B1 * | 1/2001 | Norlander | 162/157.6 |
| 6,620,293 | B2 * | 9/2003 | Sears et al. | 162/157.6 |

* cited by examiner

*Primary Examiner*—Gregory R. Del Cotto

(57) ABSTRACT

A method for making bleached crosslinked cellulosic fibers having high color and brightness properties is disclosed. In the method cellulosic fibers which have been with a crosslinking agent in the presence of a polyol are treated with a bleaching agent to yield cellulosic fibers with high color and brightness.

16 Claims, No Drawings

METHOD FOR MAKING BLEACHED CROSSLINKED CELLULOSIC FIBERS WITH HIGH COLOR AND BRIGHTNESS

FIELD

The present application relates to a method for making bleached crosslinked cellulosic fibers with high color and brightness.

BACKGROUND

Cellulosic fibers are a basic component of absorbent products such as diapers. The ability of an absorbent product containing cellulosic fibers to initially acquire and distribute liquid will generally depend on the product's dry bulk and capillary structure. However, the ability of a product to acquire additional liquid on subsequent insults will depend on the product's wet bulk. Cellulosic fibers, although absorbent, tend to collapse on wetting and to retain absorbed liquid near the point of liquid insult. The inability of wetted cellulosic fibers in absorbent products to further acquire and distribute liquid to sites remote from liquid insult can be attributed to a diminished acquisition rate due in part to the loss of fiber bulk associated with liquid absorption. Absorbent products made from cellulosic fluff pulp, a form of cellulosic fibers having an extremely high void volume, lose bulk on liquid acquisition and the ability to further wick and acquire liquid, causing local saturation.

Crosslinked cellulosic fibers generally have enhanced wet bulk compared to uncrosslinked fibers. The enhanced bulk is a consequence of the stiffness, twist, and curl imparted to the fiber as a result of crosslinking. Accordingly, crosslinked fibers are advantageously incorporated into absorbent products to enhance their wet bulk and liquid acquisition rate and to also reduce rewet.

Some of the first crosslinked cellulosic fibers were prepared by treating cellulosic fibers with formaldehyde and various formaldehyde addition products. See, for example, U.S. Pat. No. 3,224,926; U.S. Pat. No. 3,241,553; U.S. Pat. No. 3,932,209; U.S. Pat. No. 4,035,147; and U.S. Pat. No. 3,756,913. Unfortunately, the irritating effect of formaldehyde vapor on the eyes and skin is a marked disadvantage of the fibers. In addition, such crosslinked fibers typically exhibit objectionable odor and have low fiber brightness.

Alternatives to formaldehyde and formaldehyde addition product crosslinking agents have been developed. Among these are dialdehyde crosslinking agents. See, for example, U.S. Pat. No. 4,822,453, which describes absorbent structures containing individualized, crosslinked fibers, wherein the crosslinking agent is selected from the group consisting of $C_2$–$C_9$ dialdehydes, with glutaraldehyde being preferred. The reference appears to overcome many of the disadvantages associated with formaldehyde and/or formaldehyde addition products. However, the cost associated with producing fibers crosslinked with dialdehyde crosslinking agents such as glutaraldehyde is considered too high to result in significant commercial success. Therefore, further efforts have been made to improve fiber properties such as color and odor.

Polycarboxylic acids have been used to crosslink cellulosic fibers. See, for example, U.S. Pat. No. 5,137,537; U.S. Pat. No. 5,183,707; and U.S. Pat. No. 5,190,563. These references describe absorbent structures containing individualized cellulosic fibers crosslinked with a $C_2$–$C_9$ polycarboxylic acid. The ester crosslink bonds formed by the polycarboxylic acid crosslinking agents differ from the acetal crosslink bonds that result from the mono- and di-aldehyde crosslinking agents. Absorbent structures made from these individualized, ester-crosslinked fibers exhibit increased dry and wet resilience and have improved responsiveness to wetting relative to structures containing uncrosslinked fibers. Furthermore, the preferred polycarboxylic crosslinking agent, citric acid, is available in large quantities at relatively low prices making it commercially competitive with formaldehyde and formaldehyde addition products. Unfortunately, the preferred $C_2$–$C_9$ crosslinking agent, citric acid, can cause discoloration (i.e., yellowing) of the white cellulosic fibers when the treated fibers are cured at the elevated temperatures required for crosslinking It is known that decomposition of citric acid yields aconitic acid, itaconic acid, citraconic acid, and mesaconic acid. Yellowing may be due to the chromophores produced as a result of the conjugated double bonds produced or due to reactions with the double bonds. In addition, unpleasant odors can also be associated with the use of α-hydroxy polycarboxylic acids such as citric acid. The above-noted references do not describe processes that reduce the odor or increase the brightness of the treated fibers.

We have found that the color and brightness properties of citric acid and other α-hydroxypolycarboxylic acids crosslinked cellulosic fibers could be improved by crosslinking cellulosic fibers with the crosslinking agent in the presence of a polyol. It has now been discovered that further increases in color and brightness can be obtained by contacting these crosslinked fibers with an oxidizing bleaching agent (e.g, hydrogen peroxide). Alternatively, the fibers can be contacted with an aqueous solution containing hydrogen peroxide or an aqueous solution containing sodium hydroxide and hydrogen peroxide.

Although some disadvantages related to brightness and color associated with crosslinked cellulosic fibers have been addressed, a need remains for cellulosic fibers having the advantages of bulk, liquid acquisition, and rewet associated with crosslinked cellulosic fibers without the disadvantages related to diminished fiber brightness and color. The present application seeks to fulfill these needs and provides further related advantages.

SUMMARY

In one aspect, bleached crosslinked cellulosic fibers having color and brightness properties greater than unbleached crosslinked cellulosic fibers are disclosed. The bleached crosslinked cellulosic fibers are intrafiber crosslinked cellulosic fibers obtainable from cellulosic fibers by treatment with a crosslinking agent in the presence of a polyol and then bleached.

In another aspect, a method for the preparation of bleached crosslinked cellulosic fibers is provided. In the method, a fibrous web of cellulosic fibers is treated with a crosslinking agent in the presence of a polyol, cured to provide individualized crosslinked cellulosic fibers and then treated with a bleaching agent to increase the color properties and brightness. In still another aspect, absorbent products are provided incorporating the bleached crosslinked fibers.

DETAILED DESCRIPTION OF THE EMBODIMENTS

The present application provides bleached crosslinked cellulosic fibers with color properties that are increased over the color properties of unbleached crosslinked cellulosic fibers. The bleached crosslinked fibers are intrafiber crosslinked cellulosic fibers which have been processed with a crosslinking agent in the presence of a polyol and then bleached. It is understood that a catalyst is present in the solution containing the crosslinking agent. The bleached crosslinked cellulosic fibers can be made under pilot plant conditions representative of commercial production by treatment with an effective amount of a crosslinking agent and an amount of polyol effective to provide crosslinked fibers with improved color and brightness properties and then bleached to further increase these properties. The bleached crosslinked fibers have Whiteness Index ($WI_{(CDM-L)}$) values and brightness properties which are greater than crosslinked cellulosic fibers prepared under the same conditions but not bleached.

The term "polyol" means "a polyhydric alcohol, i.e., one containing three or more hydroxyl groups". Those having three hydroxyl groups (trihydric) are glycerols; those with more than three are called sugar alcohols, with general formula $CH_2OH(CHOH)_nCH_2OH$, where n may be from 2 to 10. Pigman in "The Carbohydrates", W. Pigman, Editor, Academic Press Inc., NY, 1957, divides polyols into two classes, the acyclic polyols (alditols, glycitols, or "sugar alcohols") and the alicyclic polyols (cyclitols). The term "polyol" as used in this application also includes heterosides which contain a single polyol linked by a glycosidic bond to another carbohydrate. Additionally, the polyol may be linked to one, two, or three sugars. Examples include, but are not limited to lactitol, mannitol and isomalt. The acyclic polyols include, but are not limited to, triitol which includes glycerol; tetritols including threitol and erythritol; pentitols including arabitol, xylitol, ribitol, rhamnitol and fucitol; hexitols include sorbitol, mannitol, talitol, iditol, galactitol, and allitol; heptitols include volemitol, perseitol, β-sedoheptitol, D-glycero-D-ido-heptitol, meso-D-glycero-L-ido-heptitol and siphulitol; octitols include D-erythro-L-gala-octitol, D-erythro-D-gala-octitol, erythro-manno-octitol, D-erythro-L-talo-octitol, D-threo-L-gala-octitol; α,α,α-D-Gluco-nonitol; α,α,α,α-D-Gluco-decitol. The alicyclic polyols are polyhydroxy derivatives of cyclohexane and include cis-Inositol, epi-Inositol, allo-Inositol, neo-Inositol, myo-Inositol, 1D-chiro-Inositol, 1L-chiro-Inositol, muco-Inositol, and scyllo-Innositol. Alicyclic polyols with only four hydroxyl groups include betitol, L-leucanthemitol and conduritol; cyclic polyols with five hydroxy groups include D-quercitol, L-quercitol and L-viburnitol. The heterosides include lactitol, maltitol, and isomalt. The latter consists of two components in a 1:1 mixture, 6-O-α-D-Glucopyranosyl-D-sorbitol and 1-O-α-D-Glucopyranosyl-D-mannitol. Others include clusianose, umbilicin and peltigeroside.

By bleached crosslinked cellulosic fibers is meant that cellulosic fibers are crosslinked with a crossslinking agent in the presence of a polyol and then bleached to increase the color properties and brightness above the color properties and brightness of those crosslinked fibers that have been crosslinked with a crosslinking agent and a catalyst in the presence of a polyol and have not been bleached.

The bleached crosslinked cellulosic fibers are made by treating a mat or web of cellulosic fibers with an aqueous solution of a crosslinking agent and a catalyst in the presence of the polyol to provide treated fibers, which are then separated into treated individualized fibers, and heated for a time and at a temperature to effect drying and subsequently cured (i.e., to provide intrafiber crosslinked cellulosic fibers). In one embodiment the crosslinked fibers, which have a moisture content after exiting the curing stage of about 6% to about 10%, are treated with a bleaching agent. The crosslinked cellulosic fibers are then treated with one or more bleaching agents to provide bleached crosslinked cellulosic fibers having further improved color. In one embodiment, the bleaching agent is hydrogen peroxide. In another embodiment, the bleaching agent is a combination of hydrogen peroxide and sodium hydroxide. Other suitable bleaching agents include peroxy acids (e.g. peracetic acid), sodium peroxide, chlorine dioxide, sodium chlorite, and sodium hypochlorite. Mixtures of bleaching agents may also be used. In another embodiment the cured crosslinked fibers are treated with an aqueous solution containing from about 0.2 kg. hydrogen peroxide per ADMT (air dried metric ton) fiber to about 3 kg. hydrogen peroxide per ADMT fiber. In another embodiment the cured crosslinked fibers are treated with an aqueous solution of hydrogen peroxide in combination with aqueous sodium hydroxide. In yet another embodiment the cured crosslinked fibers are treated with an aqueous solution of hydrogen peroxide to provide from about 0.2 kg. hydrogen peroxide per ADMT fiber and about 0.7 kg. sodium hydroxide per ADMT fiber to about 3 kg. hydrogen peroxide per ADMT fiber and about 1.5 kg. sodium hydroxide per ADMT fiber. A representative method for making the bleached crosslinked cellulosic fibers is described in Example 1, Method B.

The term "brightness" refers to the reflectance of blue light corresponding to a centroid wavelength of 457 nm in terms of the perfect reflecting diffuser (perfect reflecting diffuser is the ideal reflecting surface that neither absorbs nor transmits light, but reflects diffusely, with the radiance of the reflecting surface being the same for all reflecting angles, regardless of the angular distribution of the incident light). Brightness was measured according to TAPPI T 525 om-02 on a Technibrite MicroTB-1C instrument (Technydine Corp.).

The brightness and color properties of unbleached crosslinked fibers as a function of the type of polyol in the presence of a crosslinking agent are presented in Tables 1 and 2. Table 3 represents the effect of time and temperature under pilot plant conditions for preparing unbleached crosslinked fibers which are representative of commercial production.

In addition to high brightness, the unbleached crosslinked fibers prepared with the polyols exhibit improved color properties as indicated by the Opponent colors scales L, a, b values, (Hunter space), and Whiteness Index ($WI_{CDM-L}$) values. L, a and b are used to designate measured values of three attributes of surface-color appearance as follows: L represents lightness, increasing from zero for black to 100 for perfect white; a represents redness when positive, greenness when negative, and zero for gray; and b represents yellowness when positive, blueness when negative, and zero for gray. The concept of opponent colors was proposed by Hering in 1878. Starting in the 1940s, a number of measurable L, a, b dimensions have been defined by equations relating them to the basic CIE XYZ tristimulus quantities defined in CIE Document No. 15. Measured values for a given color will depend on color space in which they are expressed [(TAPPI T 1213 sp-98 "Optical measurements terminology (related to appearance evaluation of paper")].

The unbleached crosslinked fibers prepared with different polyols have Whiteness Index ($WI_{(CDM-L)}$) values greater than about 69.0 when prepared under pilot plant conditions representative of commercial production. The color properties of representative unbleached crosslinked cellulosic fibers are provided in Tables 1 and 2. These fibers represent small scale tests (20 g cellulose). Table 3 represents unbleached crosslinked fibers made in a pilot plant, representative of commercial production, using sorbitol as the polyol. Similar differences in color properties and brightness as those in Table 1 and 2 would be expected with $C_4$–$C_{12}$ polyols when processed under the pilot plant conditions.

Whiteness Index is determined using a color difference meter (CDM) and is defined as:

$$WI_{(CDM-L)}=L-3b.$$

Basic color measurement is made using commercially available instruments (e.g, Technibrite MicroTB-1C, Technydine Corp.). The instrument scans through the brightness and color filters. Fifty readings are taken at each filter position and averaged and the resulting values are printed out as Brightness, R(X), R(Y), and R(Z). Brightness is ISO brightness (457 nm), R(X) is absolute red reflectance (595 nm), R(Y) is absolute green reflectance (557 nm), and R(Z) is absolute blue reflectance (455 nm). The CIE tristimulus functions X, Y, and Z are then computed in accordance with the following equations: X= 0.782 R(X) +0.198 R(Z); Y=R(Y); and Z=1.181 R(Z). Next L, a and b values are computed using the established equations (Technibrite Micro TB-1C Instruction Manual TTM 575-08, Oct. 30, 1989). $WI_{(CDM-L)}$ was calculated according to the equation: $WI_{(CDM-L)}=L-3b$, according to TAPPI T 1216 sp-98 (TAPPI T 1216 sp-98 "Indices for whiteness, yellowness, brightness and luminous reflectance factor").

To further illustrate the principles, a discussion of whiteness and brightness is useful. Webster's Dictionary defines white as "the object color of greatest lightness characteristically perceived to belong to objects that reflect diffusely nearly all incident energy throughout the visible spectrum". Used as a noun or adjective, white is defined as "free from color". Most natural and many man-made products are never "free from color". Whether the "white" product is fluff pulp, paper, textiles, plastics, or teeth, there is usually an intrinsic color, other than white, associated with it. Consider two hypothetical objects, the first that meets Webster's definition of white: one characterized by a flat spectrum of high reflectance and a second, which is the first with a small amount of blue colorant added (results in an unequal spectrum). Most people will judge the second as being the whiter of the two even though its total reflectance is lower in certain spectral regions. The first will be judged as a "yellow-white" while the second a "blue-white". Human color vision is more than just a sensation. It is also quite subjective and certain associations are unconsciously made. Blue-white is associated with "clean and pure", while "yellow-white" denotes "dirty, old or impure". The type and amounts of fillers and colorants to use, which hues are appropriate (e.g, red-blue, green-blue), and the optimal optical prescription to target have been the subject of considerable interest.

In another aspect, the present application provides a method for making bleached crosslinked cellulosic fibers. In the method, cellulosic fibers are treated with an effective amount of a polyol in the presence of an effective amount of a crosslinking agent. As used herein, an effective amount of crosslinking agent is from about 1% to about 10% by weight of the crosslinking agent based on the total weight of the cellulose fibers; an effective amount of the polyol is and from about 1% to about 10% by weight polyol based on the total weight of the fibers. Dried cured unbleached crosslinked fibers resulting from these treatments are then treated with an aqueous solution of hydrogen peroxide or alternatively, an aqueous solution of sodium hydroxide and hydrogen peroxide. In yet another embodiment of the invention the fibers prepared with the crosslinking agent in the presence of a polyol and then bleached have a wet bulk of at least about 15.5 cc/g.

In another method the cellulose mat is treated with the polyol by methods known in the art, including spraying, rolling or dipping before the polyol treated sheet is impregnated with the crosslinking solution.

In another method the defiberized fiber is treated with the crosslinking agent, is dried and the polyol is applied to the crosslinked treated fibers before the curing stage, the dried cured unbleached crosslinked fiber is then treated with a bleaching agent.

In general, the cellulose fibers may be prepared by a system and apparatus as described in U.S. Pat. No. 5,447,977 to Young, Sr. et al. Briefly, the fibers are prepared by a system and apparatus that includes a conveying device for transporting a mat or web of cellulose fibers through a fiber treatment zone; an applicator for applying a treatment substance such as an aqueous solution of the crosslinking agent from a source to the fibers at the fiber treatment zone; a fiberizer for separating the individual cellulose fibers comprising the mat to form a fiber output comprised of substantially unbroken and essentially singulated cellulose fibers; a dryer coupled to the fiberizer for flash evaporating residual moisture; and a controlled temperature zone for additional heating of fibers for drying and an oven for curing the crosslinking agent, to form dried and cured individualized crosslinked fibers.

As used herein, the term "mat" refers to any nonwoven sheet structure comprising cellulose fibers or other fibers that are not covalently bound together. The fibers include fibers obtained from wood pulp or other sources including cotton rag, hemp, grasses, cane, husks, cornstalks, or other suitable sources of cellulose fibers that may be laid into a sheet. The mat of cellulose fibers is preferably in an extended sheet form, and may be one of a number of baled sheets of discrete size or may be a continuous roll.

Each mat of cellulose fibers is transported by a conveying device, for example, a conveyor belt or a series of driven rollers. The conveying device carries the mats through the fiber treatment zone.

At the fiber treatment zone, an aqueous solution of the crosslinking agent is applied to the cellulose fibers. The crosslinking solutions are preferably applied to one or both surfaces of the mat using any one of a variety of methods known in the art, including spraying, rolling, or dipping The polyol may be applied to the cellulose sheet before the application of the crosslinking solution, with the crosslinking solution, or after the passage of the sheet through the fiberizer so that the polyol is applied to the individualized crosslinked treated fibers. In the latter case, the polyol can be injected into the hot air stream conveying the individualized fiber into the curing stage. Once the crosslinking solution and polyol have been applied to the mat, they may be uniformly distributed through the mat, for example, by passing the mat through a pair of rollers.

After the fibers have been treated with the crosslinking agent and the polyol, the impregnated mat is fiberized by feeding the mat through a fiberizer. The fiberizer serves to disintegrate the mat into its component individual cellulose fibers, which are then air conveyed through a drying unit to remove the residual moisture. In one embodiment, the fibrous mat is wet fiberized.

The pulp is then air conveyed through an additional heating zone to bring the temperature of the pulp to the cure temperature. The cure temperature for citric acid is about 170° C. In one embodiment, the dryer comprises a first drying zone for receiving the fibers and for removing residual moisture from the fibers via a flash-drying method and a second heating zone for curing the crosslinking agent. Alternatively, in another embodiment, the treated fibers are blown through a flash-dryer to remove residual moisture, heated to a curing temperature, and then transferred to an oven where the treated fibers are subsequently cured. Overall, the treated fibers are dried and then cured for a sufficient time and at a sufficient temperature to effect crosslinking Typically, the fibers are oven-dried and cured for about 15 seconds to about 20 minutes at a temperature from about 120° C. to about 215° C. After curing the unbleached fibers, usually at about 6% to 10% total moisture, are treated with a bleaching agent to increase the color and brightness properties.

As noted above, the present application relates to bleached crosslinked cellulose fibers. Although available from other sources, cellulosic fibers useful for making bleached crosslinked cellulosic fibers are derived primarily from wood pulp. Suitable wood pulp fibers can be obtained from well-known chemical processes such as the kraft and sulfite processes, with or without subsequent bleaching The pulp fibers may also be processed by thermomechanical, chemithermomechanical methods, or combinations thereof. The pulp fiber is produced by chemical methods. Ground wood fibers, recycled or secondary wood pulp fibers, and bleached and unbleached wood pulp fibers can be used. The starting material is prepared from long-fiber coniferous wood species, such as southern pine, Douglas fir, spruce, and hemlock. Details of the production of wood pulp fibers are well-known to those skilled in the art. These fibers are commercially available from a number of companies, including Weyerhaeuser Company. For example, suitable cellulose fibers produced from southern pine are available from Weyerhaeuser Company under the designations CF416, CF405, NF405, PL416, FR416, FR516, NB416, dissolving pulps from northern softwood include MAC11 Sulfite, M919, WEYCELL and TR978 all of which have an alpha cellulose content of 95% and PH which has an alpha cellulose content of 91%. High purity mercerized pulps such as HPZ, HPZ111, HPZ4, and HPZ-XS available from Buckeye and Porosonier-J available from Rayonier are also suitable.

The wood pulp fibers can also be pretreated prior to use. This pretreatment may include physical treatment, such as subjecting the fibers to steam or chemical treatment. Although not to be construed as a limitation, examples of pretreating fibers include the application of fire retardants to the fibers, and surfactants or other liquids, such as solvents, which modify the surface chemistry of the fibers. Other pretreatments include incorporation of antimicrobials, pigments, and densification or softening agents. Fibers pretreated with other chemicals, such as thermoplastic and thermosetting resins also may be used. Combinations of pretreatments also may be employed.

Method for determining fiber brightness. The brightness (% ISO) of cellulosic fibers crosslinked with citric acid was determined by TAPPI T 525 om-02.

The $WI_{(CDM-L)}$, brightness, L, a, and b values of representative unbleached crosslinked fibers prepared with citric acid as the crosslinking agent, in the presence of various polyols and various levels of the polyol, using method A, are presented in Table 1; Table 2 represents unbleached fibers crosslinked with malic acid in the presence of sorbitol by the same method. Table 3 shows the effect of cure temperature and time on $WI_{(CDM-L)}$ and brightness when fibers are crosslinked with citric acid in the presence of sorbitol using the large scale production method B and not bleached. Table 4 shows the color and brightness properties of bleached crosslinked fibers of the invention. In each case, depending on curing temperature and time and bleaching conditions, crosslinking in the presence of a polyol followed by bleaching results in color and brightness properties which are increased over fibers that are crosslinked and not bleached. For $WI_{(CDM-L)}$, this increase ranged from approximately one unit to approximately 6.9 units The following examples are for the purposes of illustrating, and should not be construed as limitations.

EXAMPLE 1

Representative Crosslinked Cellulosic Fibers Prepared With Sorbitol

In this example, methods for forming unbleached crosslinked fibers with improved brightness and color are described.

Method A. A selected amount of a solution sufficient to apply 2, 8, and 2% by weight on cellulosic fibers, of sorbitol, citric acid and sodium hypophosphite, respectively, was applied to both sides of a twenty gram pulp sheet (CF416 dried wood pulp fibers available from Weyerhaeuser Co.) using a 5 mL disposable syringe and 23.1 gauge needle. The sample was held in a resealable plastic bag for 16–18 hours at room temperature, then broken into pieces (e.g, about 2×2 cm), passed through a laboratory fiberizer, and collected as a loose pad. The pad was broken into small pieces (e.g, about 3×3 cm), placed into a screen basket and cured at a fixed temperature and time in a Despatch V Series oven.

Unbleached citric acid crosslinked fibers with improved color and brightness properties prepared by this method with sorbitol and other polyols at 2 to 10% of the weight of the cellulose fiber have $WI_{(CDM-L)}$ values, brightness, L, a, and b values described in Table 1; Table 2 represents brightness and color properties of unbleached fibers crosslinked with malic acid in the presence of sorbitol using the same method.

Method B. This pilot plant method is representative of commercial production. Pulp sheets in roll form (CF416, dried wood pulp fibers available from Weyerhaeuser Co.) were treated with citric acid and sorbitol and then bleached according to the following procedure. The pulp sheet was fed from a roll through a constantly replenished bath of the crosslinking agent and sorbitol solution (i.e., an aqueous solution containing a citric acid and sorbitol concentration determined by the weight add-on desired), then through a roll nip set to remove sufficient solution so that the pulp sheet after treating was at about 40% by weight moisture content. The concentration of the bath was adjusted to achieve the desired level of chemical addition to the pulp sheet. After the roll nip, the wet sheet was fed through a fiberizer to fiberize the pulp. The individualized fibers were then blown through a flash dryer to affect drying and then to a cyclone where the treated cellulose fluff was separated from the air stream. The pulp was air conveyed through an additional heating zone to bring the temperature of the pulp to the cure temperature and then transferred to an oven where the treated fibers were subsequently cured. In cases where the fibers were bleached, the sodium hydroxide solution or the sodium peroxide solution and the hydrogen peroxide solution were injected into the fiber stream after curing at levels indicated in Table 4. When only aqueous hydrogen peroxide was used, levels ranged from 0.45 kg./ADMT fiber to 0.9 kg./ADMT fiber; when aqueous hydrogen peroxide and aqueous sodium peroxide were used, hydrogen peroxide ranged from 0.36 to 2.27 kg./ADMT and sodium hydroxide ranged from 0.9 to 1.13 kg./ADMT fiber. Unbleached and bleached crosslinked fibers prepared by this method have the $WI_{(CDM-L)}$ brightness, L, a, and b and FAQ values described in Table 4.

Method for determining fiber wet bulk. The wet bulk of crosslinked cellulosic was determined by the Fiber Absorption Quality (FAQ) Analyzer (Weyerhaeuser Co. Federal Way, WA) using the following procedure. A 4-gram sample of the pulp is put through a pinmill to open the pulp and then airlaid into a tube. The tube is then placed in the FAQ Analyzer. A plunger then descends on the fluff pad at a pressure of 0.6 kPa and the pad height bulk determined. The weight is increased to achieve a pressure of 2.5 kPa and the bulk recalculated. The result, the two bulk measurements on the dry fluff pulp at two different pressures. While under the 2.5 kPa pressure, water is introduced into the bottom of the tube (bottom of the pad). The time required for water to reach the plunger is measured. From this the absorption time and rate are determined. The final bulk of the wet pad at 2.5 kPa is also measured. The plunger is then withdrawn from the tube and the wet pad allowed to expand for 60 seconds. The plunger is reapplied at 0.6 kPa and the bulk determined. The final bulk of the wet pad at 0.6 kPa is considered the wet bulk (cc/g) of the pulp product.

TABLE 1

Properties Of Representative Crosslinked Fibers Prepared By Crosslinking Cellulose Fibers With Citric Acid And Various Polyols And Not Bleached

| Pulp | Additive | Additive Wt. % on fiber | FAQ Wet Bulk, cc/g | ISO Brightness % | L | a | b | $WI_{(CDM-L)}$ |
|---|---|---|---|---|---|---|---|---|
| CF416 | No additive | 0 | 17.6 | 82.1 | 95.58 | −1.38 | 7.27 | 73.77 |
| CF416 | Erythritol | 2 | 17.9 | 84.5 | 95.35 | −1.12 | 5.01 | 80.32 |
| CF416 | Xylitol | 2 | 17.7 | 84.8 | 95.45 | −1.11 | 4.97 | 80.54 |
| CF416 | Arabitol | 2 | 18.2 | 84.7 | 95.48 | −0.92 | 5.08 | 80.24 |
| CF416 | Ribitol | 2 | 18.4 | 85.1 | 95.53 | −0.91 | 4.88 | 80.89 |
| CF416 | Sorbitol | 2 | 17.6 | 85 | 95.44 | −1.07 | 4.78 | 81.1 |
| CF416 | Mannitol | 2 | 17.9 | 85.3 | 95.5 | −0.95 | 4.59 | 81.73 |
| CF416 | Lactitol | 2 | 18.4 | 83.6 | 95.47 | −1.05 | 5.92 | 77.71 |
| CF416 | Maltitol | 2 | 17.9 | 84.5 | 96.14 | −1.27 | 6.14 | 77.72 |
| CF416 | Isomalt | 2 | 17.7 | 81.7 | 94.71 | −0.84 | 6.3 | 75.81 |
| CF416 | myo-Inositol | 2 | 18.6 | 83.4 | 95.49 | −1.09 | 6.11 | 77.16 |
| CF416 | No additive | 0 | 17.6 | 82.1 | 95.58 | −1.38 | 7.27 | 73.77 |
| CF416 | Erythritol | 6 | 16.2 | 86.4 | 95.8 | −0.92 | 4.24 | 83.08 |
| CF416 | Xylitol | 6 | 16 | 86.4 | 95.67 | −0.86 | 3.99 | 83.7 |
| CF416 | Arabitol | 6 | 16.4 | 86.6 | 95.61 | −0.62 | 3.83 | 84.12 |
| CF416 | Ribitol | 6 | 17.2 | 86.4 | 95.6 | −0.69 | 3.91 | 83.87 |
| CF416 | Sorbitol | 6 | 16.1 | 85.9 | 95.42 | −0.83 | 4.05 | 83.27 |
| CF416 | Mannitol | 6 | 16.9 | 86.3 | 95.62 | −0.78 | 4.02 | 83.56 |
| CF416 | Lactitol | 6 | 17.4 | 84.8 | 95.59 | −0.83 | 5.12 | 80.23 |
| CF416 | Maltitol | 6 | 16.9 | 82.2 | 94.41 | −0.69 | 5.43 | 78.12 |
| CF416 | Isomalt | 6 | 16.5 | 82.8 | 94.92 | −0.75 | 5.65 | 77.97 |
| CF416 | myo-Inositol | 6 | 16.8 | 84.4 | 95.3 | −0.71 | 5.03 | 80.21 |
| CF416 | No additive | 0 | 17.6 | 82.1 | 95.58 | −1.38 | 7.27 | 73.77 |
| CF416 | Erythritol | 10 | 14.9 | 86.6 | 95.63 | −1 | 3.77 | 84.32 |
| CF416 | Xylitol | 10 | 14.7 | 87.1 | 95.75 | −0.81 | 3.56 | 85.07 |
| CF416 | Arabitol | 10 | — | — | — | — | — | — |
| CF416 | Ribitol | 10 | — | — | — | — | — | — |
| CF416 | Sorbitol | 10 | 15 | 87 | 95.77 | −0.79 | 3.66 | 84.79 |
| CF416 | Mannitol | 10 | 15.7 | 86.2 | 95.53 | −0.84 | 3.94 | 83.71 |
| CF416 | myo-Inositol | 10 | — | — | — | — | — | — |

Experimental conditions: 8% by weight citric acid on cellulose fibers, 2% by weight sodium hypophosphite on cellulose fibers, additive as listed, cured at 170° C. for 7 min.

TABLE 2

Properties Of Representative Crosslinked Fibers Prepared By Crosslinking with Malic Acid In The Presence Of Sorbitol And Not Bleached

| Pulp | Crosslinking Agent | Additive | Additive, Wt. % on fiber | FAQ Wet Bulk, cc/g | ISO Brightness % | L | a | b | $WI_{(CDM-L)}$ |
|---|---|---|---|---|---|---|---|---|---|
| CF416 | Malic Acid | None | — | 16.8 | 79.2 | 94.64 | −1.12 | 8.12 | 70.28 |
| CF416 | Malic Acid | Sorbitol | 2 | 15.7 | 84.2 | 95.71 | −0.95 | 5.81 | 74.28 |
| CF416 | Malic Acid | Sorbitol | 4 | 14.9 | 84 | 95.47 | −1 | 5.66 | 78.49 |
| CF416 | Malic Acid | Sorbitol | 6 | 13.8 | 85.9 | 96.03 | −0.83 | 4.92 | 81.27 |

Experimental conditions: 8% by weight malic acid on cellulose fibers, 2% by weight sodium hypophosphite on cellulose fibers, sorbitol as listed, cured at 170° C. for 7 min.

TABLE 3

Properties Of Representative Crosslinked Fibers Prepared By Crosslinking Cellulosic Fibers With Citric Acid In The Presence Of Sorbitol And Not Bleached

| Pulp | Additive | Additive, Wt. % on fiber | Cure Temp, ° C. | Cure Time Min. | FAQ Wet Bulk, cc/g | ISO Brightness % | L | a | b | $WI_{(CDM-L)}$ |
|---|---|---|---|---|---|---|---|---|---|---|
| CF416 | none | 0 | 182 | 5 | 16.2 | 78.4 | 94.7 | −1.58 | 8.77 | 68.39 |
| CF416 | Sorbitol | 1.5 | 182 | 5 | 16.1 | 83.09 | 95.25 | −1.28 | 6.0 | 77.25 |
| CF416 | none | 0 | 182 | 7 | 17.2 | 75.6 | 94.1 | −1.59 | 10.11 | 63.77 |
| CF416 | Sorbitol | 1.5 | 182 | 7 | 16.6 | 82.7 | 95.8 | −1.54 | 7.02 | 74.74 |
| CF416 | none | 0 | 193 | 5 | 17.5 | 74.5 | 93.9 | −1.57 | 10.67 | 61.89 |
| CF416 | Sorbitol | 1.5 | 193 | 5 | 16.6 | 81.69 | 95.36 | −1.31 | 7.21 | 73.73 |
| CF416 | none | 0 | 193 | 7 | 17.7 | 70.3 | 92.8 | −1.49 | 12.48 | 55.36 |
| CF416 | Sorbitol | 1.5 | 193 | 7 | 16.8 | 79.50 | 94.96 | −1.51 | 8.33 | 69.97 |

Experimental conditions: 6% by weight citric acid on cellulose fibers, 0.75% by weight sodium hypophosphite on cellulose fibers, additive as listed, cured as indicated

TABLE 4

Cellulosic Fibers Crosslinked With Citric Acid In The Presence Of Sorbitol Then Bleached

| Sample | Cure Temp., ° C. | Cure Time, Min. | $H_2O_2$, Kg./ ADMT Fiber | NaOH, Kg./ ADMT Fiber | Brightness ISO % | L | a | b | $WI_{(CDM-L)}$ | FAQ cc/g |
|---|---|---|---|---|---|---|---|---|---|---|
| A | 182 | 5 | 0 | 0 | 83.09 | 95.25 | −1.28 | 6 | 77.25 | 16.1 |
| B | 182 | 5 | 0.36 | 1.13 | 83.7 | 95.36 | −1.22 | 5.7 | 78.26 | 15.8 |
| C | 182 | 7 | 0 | 0 | 82.2 | 95.6 | −1.53 | 7.1 | 74.29 | 16.9 |
| D | 182 | 7 | 0.45 | 0 | 84.8 | 96.5 | −1.6 | 6.33 | 77.51 | 16.9 |
| E | 182 | 7 | 0.45 | 0.9 | 84.7 | 96.3 | −1.53 | 6.14 | 77.88 | 16.3 |
| F | 182 | 7 | 0.9 | 0 | 85.2 | 96.5 | −1.63 | 6.05 | 78.35 | 17 |
| G | 182 | 7 | 0.9 | 0.9 | 85.4 | 96.5 | −1.53 | 5.92 | 78.74 | 16.6 |
| H | 182 | 7 | 0.36 | 1.13 | 82.42 | 95.19 | −1.38 | 6.42 | 75.93 | 16.4 |
| I | 182 | 7 | 1.13 | 1.13 | 86.3 | 96.3 | −1.27 | 5.06 | 81.12 | 15.7 |
| J | 182 | 7 | 2.27 | 1.13 | 86.3 | 96.3 | −1.32 | 5.03 | 81.21 | 16.5 |
| K | 193 | 5 | 0 | 0 | 81.69 | 95.36 | −1.31 | 7.21 | 73.73 | 16.6 |
| L | 193 | 5 | 0.36 | 1.13 | 82.56 | 95.57 | −1.3 | 6.83 | 75.08 | 15.9 |
| M | 193 | 7 | 0 | 0 | 79.5 | 94.96 | −1.51 | 8.33 | 69.97 | 16.8 |
| N | 193 | 7 | 0.36 | 1.13 | 80.49 | 95.11 | −1.4 | 7.78 | 71.77 | 16.7 |

Experimental conditions: CF 416 pulp, 6% by weight citric acid on cellulose fibers, 0.75%, by weight sodium hypophosphite on cellulose fibers, additive as listed, cured as indicated The present application provides bleached crosslinked cellulosic fibers. The fibers are bleached intrafiber crosslinked cellulosic fibers obtainable from cellulosic fibers by treatment with a crosslinking agent in the presence of a polyol and subsequently bleached. The crosslinked fibers can be formed from cellulosic fibers by treatment with a polyol in the presence of a crosslinking agent and then bleached to provide the color and brightness differences described herein.

The bleached crosslinked cellulosic fibers can be incorporated into an absorbent product. Such products can further include other fibers such as fluff pulp fibers, synthetic fibers, other crosslinked fibers, and absorbent materials such as superabsorbent polymeric materials. Representative absorbent products that can include the fibers include infant diapers, adult incontinence products, and feminine hygiene products. The fibers can be included in liquid acquisition, distribution, or storage layers. The bleached crosslinked cellulosic fibers can also be incorporated into tissue and towel products.

Additionally, the fibers can be incorporated into paperboard products, including single and multi-ply paperboard products. Paperboard products that include the fibers can be used in insulation applications, for example, insulated cups and containers. Paperboard products that include the fibers can also be used as packaging materials.

While various embodiments of the invention have been illustrated and described, it will be appreciated that the present invention can be practiced by other than the described embodiments, which are presented for purposes of illustration and not limitation, and present invention is limited only by the claims that follow.

What is claimed is:

1. A method for forming bleached crosslinked cellulosic fibers comprising the steps of:

applying an effective amount of a crossslinking agent which is at least one alpha-hydroxy polycarboxylic acid, and of an effective amount of a polyol to a mat of cellulosic fibers, separating the mat into substantially individualized fibers, drying the treated individualized fibers, curing the crosslinking agent in the presence of the polyol to form individualized intrafiber crosslinked cellulosic fibers, treating said crosslinked cellulosic fibers with a bleaching agent.

2. The method of claim 1, wherein the crosslinking agent is selected from the group consisting of malic acid, tartaric acid, citric acid, tartronic acid, α-hydroxyglutaric acid, and citramalic acid and mixtures thereof.

3. The method of claim 2, wherein the crosslinking agent is citric acid.

4. The method of claim 2, wherein the crosslinking agent is malic acid.

5. The method of claim 1, wherein the polyol is selected from the group consisting of acyclic polyols, alicyclic polyols and heterosides and mixtures thereof.

6. The method of claim 5, wherein the acyclic polyol is selected from the group consisting of erythritol, xylitol, arabitol, ribitol, sorbitol, mannitol, perseitol, and volemitol and mixtures thereof.

7. The method of claim 6, wherein the acyclic polyol is sorbitol.

8. The method of claim 5, wherein the alicyclic polyol is myo-Inositol.

9. The method of claim 5, wherein the heteroside is selected from the group of isomalt, lactitol, and maltitol and mixtures thereof.

10. The method of claim 9, wherein the heteroside is maltitol.

11. The method of claim 9, wherein the heteroside is lactitol.

12. The method of claim 1, wherein the polyol is applied to the cellulose mat before the application of the crosslinking agent.

13. The method of claim 1, wherein the bleaching agent comprises hydrogen peroxide.

14. The method of claim 13, wherein the hydrogen peroxide is applied to the fibers in an amount from about 0.2 kg /ADMT fiber to about 3 kg./ADMT fiber.

15. The method of claim 13, further comprising sodium hydroxide.

16. The method of claim 15, wherein the sodium hydroxide is applied in an amount of from about 0.7 kg./ADMT fiber to about 1.5 kg./ADMT fiber.

* * * * *